US008396383B2

(12) United States Patent
Honjoh et al.

(10) Patent No.: US 8,396,383 B2
(45) Date of Patent: Mar. 12, 2013

(54) IMAGE FORMING APPARATUS AND PROCESS CARTRIDGE

(75) Inventors: Kenji Honjoh, Yokohama (JP); Hirotaka Hatta, Kawasaki (JP); Toshiya Satoh, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 457 days.

(21) Appl. No.: 12/659,857

(22) Filed: Mar. 24, 2010

(65) Prior Publication Data

US 2010/0247123 A1 Sep. 30, 2010

(30) Foreign Application Priority Data

Mar. 25, 2009 (JP) ..... 2009-073812

(51) Int. Cl.
*G03G 15/00* (2006.01)

(52) U.S. Cl. ..... 399/44; 399/71

(58) Field of Classification Search ..... 399/26, 399/44, 50, 55, 71, 111, 121, 167, 343, 349
See application file for complete search history.

(56) References Cited

U.S. PATENT DOCUMENTS

| | | | | |
|---|---|---|---|---|
| 6,445,896 | B1 | 9/2002 | Satoh | |
| 7,242,885 | B2 * | 7/2007 | Abe et al. | 399/111 |
| 2007/0122217 | A1 | 5/2007 | Nagashima et al. | |

FOREIGN PATENT DOCUMENTS

| | | |
|---|---|---|
| JP | 06-149129 | 5/1994 |
| JP | 3985931 | 3/2007 |
| JP | 4229583 | 2/2009 |

OTHER PUBLICATIONS

Abstract of JP 2002-091255 Mar. 27, 2002 which corresponds to Japanese Patent No. JP 3985931.
Abstract of JP 2002-174996 Jun. 21, 2002 which corresponds to Japanese Patent No. JP 4229583.

* cited by examiner

*Primary Examiner* — William J Royer
(74) *Attorney, Agent, or Firm* — Harness, Dickey & Pierce

(57) ABSTRACT

An image forming apparatus including an image carrier; a charger to charge a surface of the image carrier; an irradiating device to form a latent image; a developing device to form a toner image; a transfer device to transfer the toner image onto a recording medium; a cleaning device to remove residual toner from the surface of the image carrier; a temperature and humidity detector to measure temperature and humidity within the image forming apparatus; a stop time clock to measure a period of time for which the image carrier is not driven; a removal unit to remove discharge products adhering to the surface of the image carrier; and a control unit to drive the removal unit to remove the discharge products for a period of time determined by the control unit based on measurements obtained by the temperature and humidity detector and the stop time clock.

12 Claims, 8 Drawing Sheets

IMAGE FORMING APPARATUS AND PROCESS CARTRIDGE

PRIORITY STATEMENT

The present patent application claims priority from Japanese Patent Application No. 2009-073812, filed on Mar. 25, 2009 in the Japan Patent Office, which is hereby incorporated herein by reference in its entirety.

BACKGROUND

1. Technical Field

Illustrative embodiments described in this patent specification generally relate to an image forming apparatus including an image carrier, a charger that charges the image carrier, a developing device that develops a latent image formed on the image carrier with toner to form a toner image on the image carrier, a transfer device that transfers the toner image formed on the image carrier onto a recording medium, and a cleaning device that removes residual toner adhering to the image carrier after transfer of the toner image onto the recording medium. Further illustrative embodiments described in this patent specification generally relate to a process cartridge removably installable in the image forming apparatus.

2. Description of the Related Art

Related-art image forming apparatuses, such as copiers, printers, facsimile machines, and multifunction devices having two or more of copying, printing, and facsimile functions, typically form a toner image on a recording medium (e.g., a sheet of paper, and the like) according to image data using an electrophotographic method. In such a method, for example, a charger charges a surface of an image carrier (e.g., a photoconductor); an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet; and a fixing device applies heat and pressure to the sheet bearing the toner image to fix the toner image onto the sheet. The sheet bearing the fixed toner image is then discharged from the image forming apparatus.

In the image forming apparatuses, the photoconductor is generally charged by electric discharge from a scorotron charger or the like, and products such as ozone are generated as a result. The products generated by electric discharge from the scorotron charger (hereinafter referred to as discharge products) must be dissolved using a catalyst and the like. For example, a fan or a blower is widely used to generate a flow of air to dissolve the discharge products through a filter including the catalyst and to discharge the dissolved products from the image forming apparatuses.

However, increasing demand for greater compactness of the image forming apparatuses reduces installation space for each component within the image forming apparatuses, necessitating use of complex shapes for the components. Consequently, the discharge products generated by electric discharge from the scorotron charger or the like cannot be completely cleared away using the catalyst and fan or blower described above. As a result, the discharge products may remain attached to a unit storing the charger or a charging member within the image forming apparatuses. The discharge products adhering to the unit storing the charger or the like may drop onto the surface of the photoconductor while the flow of air is stopped when the image forming apparatuses are turned off, for example at night, causing image deterioration, white spots, and the like. Further, the discharge products are hygroscopic, and therefore tend to attach to the surface of the photoconductor under high- temperature and high-humidity conditions.

In order to solve the above-described problems, a variety of techniques has been proposed to remove the discharge products generated by the electric discharge from the charger.

For example, scrubbers that remove the discharge products adhering to the surface of the photoconductor have been additionally provided to the image forming apparatuses. However, adding the scrubbers requires additional installation space therefor within the image forming apparatuses, thus complicating component design and increasing costs. Further, the surface of the photoconductor may be abraded by operation of the scrubbers, possibly shortening product life of the photoconductor.

In another approach, Published Unexamined Japanese Patent Application No. H06-149129 (hereinafter referred to as JP-H06-149129-A) discloses a technique in which reversal fog development of developer is performed on the surface of a photoconductor by driving a charger and applying a bias to a developing device while the apparatus warms up to remove substances adhering to the surface of the photoconductor the using a cleaning device. However, application of the bias to the developing device may itself generate the discharge products, and moreover, reversal fog development consumes a large amount of toner.

In yet another approach, in JP-2002-174996-A a technique in which a developed toner layer formed on the surface of a photoconductor is stopped at a position opposite a charger while the photoconductor is not driven has been proposed to prevent adhesion of a discharge products to the surface of a photoconductor. However, although the developed toner layer is formed at the position opposite the charger as described above, operation intervals are not changed even when a degree of adhesion of the toner is different.

In JP-3985931-B, still yet another technique has been proposed in which a scrubber including a water-bearing elastic layer and a high-absorbency layer is provided in addition to a cleaning device. The scrubber contacts a photoconductor to remove discharge products. However, because the scrubber is additionally provided as described above, additional installation space for the scrubber is required within the image forming apparatus, with the attendant disadvantages described above.

SUMMARY

In view of the foregoing, illustrative embodiments described herein provide an image forming apparatus capable of removing discharge products adhering to a surface of an image carrier without additional scrubbers to minimize the time required for removing the discharge products. Further illustrative embodiments described herein provide a process cartridge removably installable in the image forming apparatus.

At least one embodiment provides an image forming apparatus including an image carrier; a charger to charge a surface of the image carrier; an irradiating device to form a latent image on the surface of the image carrier; a developing device to develop the latent image with toner to form a toner image on the surface of the image carrier; a transfer device to transfer the toner image onto a recording medium; a cleaning device to remove residual toner from the surface of the image carrier after transfer of the toner image; a temperature and humidity detector to measure temperature and humidity within the image forming apparatus; a stop time clock to measure a period of time for which the image carrier is not driven; a removal unit to remove discharge products adhering to the surface of the image carrier when the image carrier, the developing device, and the cleaning device are driven without applying a bias to the charger while the transfer device is separated from the image carrier; and a control unit to drive the removal unit to remove the discharge products adhering to the surface of the image carrier for a period of time determined by the control unit based on measurements obtained by the temperature and humidity detector and the stop time clock.

At least one embodiment provides a process cartridge removably installable in an image forming apparatus. The process cartridge includes an image carrier; and at least one of a charger to charge a surface of the image carrier, a developing device to develop a latent image formed on the surface of the image carrier with toner to form a toner image on the surface of the image carrier, and a cleaning device to remove residual toner from the surface of the image carrier after transfer of the toner image.

At least one embodiment provides an image forming apparatus including image bearing means for bearing a latent image; charging means for charging a surface of the image bearing means; irradiating means for irradiating the surface of the image bearing means to form a latent image on the surface of the image bearing means; developing means for developing the latent image with toner to form a toner image on the surface of the image bearing means; transfer means for transferring the toner image onto a recording medium; cleaning means for removing residual toner from the surface of the image bearing means after transfer of the toner image; temperature and humidity detection means for detecting temperature and humidity within the image forming apparatus; stop time measurement means for measuring a period of time for which the image bearing means is not driven; removing means for removing discharge products adhering to the surface of the image bearing means when the image bearing means, the developing means, and the cleaning means are driven without applying a bias to the charging means while the transfer means is separated from the image bearing means; and control means for driving the removing means to remove the discharge products adhering to the surface of the image bearing means for a period of time determined by the control means based on measurements obtained by the temperature and humidity detection means and the stop time measurement means.

Additional features and advantages of the illustrative embodiments will be more fully apparent from the following detailed description, the accompanying drawings, and the associated claims.

BRIEF DESCRIPTION OF THE DRAWINGS

A more complete appreciation of the illustrative embodiments described herein and the many attendant advantages thereof will be readily obtained as the same becomes better understood by reference to the following detailed description when considered in connection with the accompanying drawings, wherein.

Figure 1:
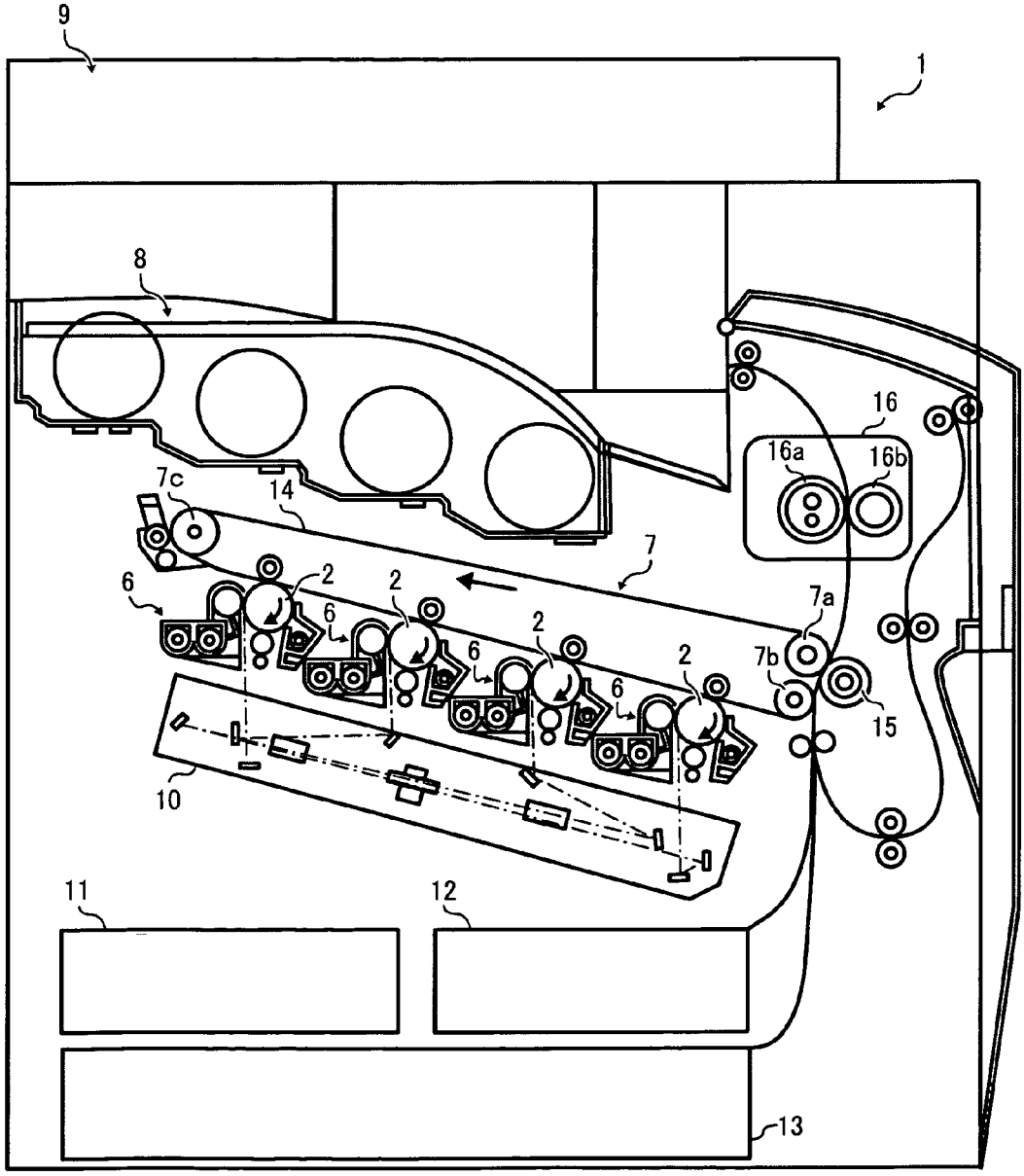
FIG. 1 is a vertical cross-sectional view illustrating an overall configuration of an image forming apparatus according to illustrative embodiments.

The accompanying drawings are intended to depict illustrative embodiments and should not be interpreted to limit the scope thereof. The accompanying drawings are not to be considered as drawn to scale unless explicitly noted.

DETAILED DESCRIPTION OF ILLUSTRATIVE EMBODIMENTS

In describing illustrative embodiments illustrated in the drawings, specific terminology is employed for the sake of clarity. However, the disclosure of this specification is not intended to be limited to the specific terminology so selected, and it is to be understood that each specific element includes all technical equivalents that operate in a similar manner and achieve a similar result.

A description is now given of illustrative embodiments of the present invention with reference to drawings, wherein like reference numerals designate identical or corresponding parts throughout the several views. It is to be noted that although drum-type photoconductors are used as an image carrier in the following illustrative embodiments, the image carrier is not limited thereto.

Figure 2:
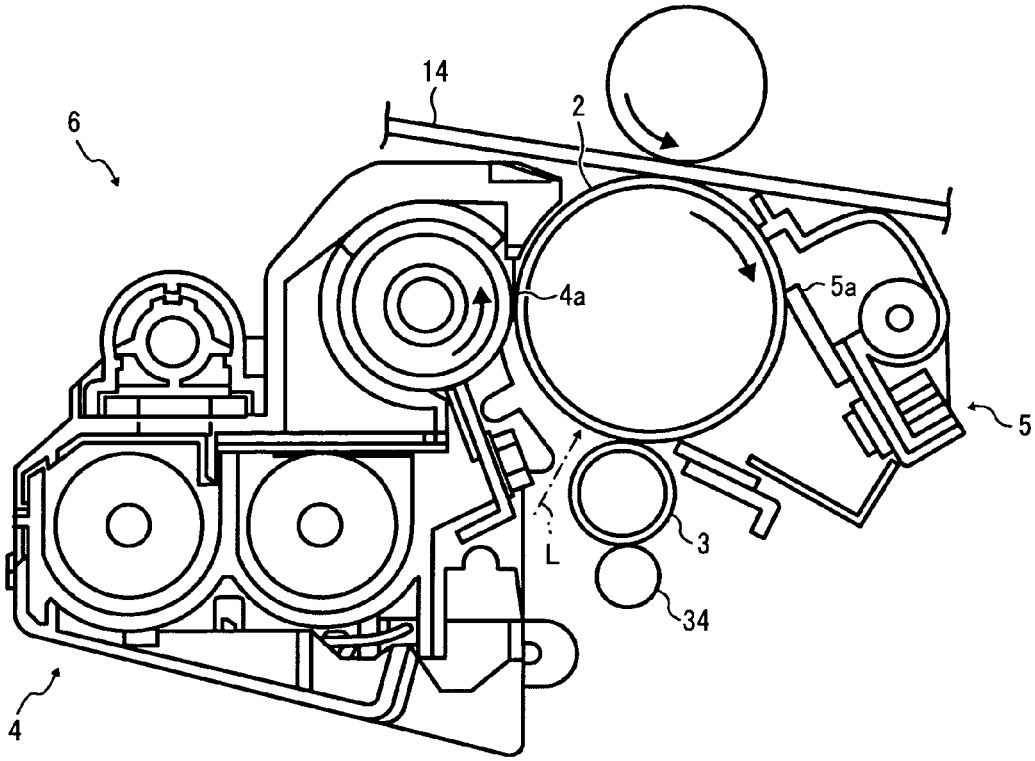
FIG. 2 is a vertical cross-sectional view illustrating an example of a configuration of a process cartridge included in the image forming apparatus illustrated in FIG. 1.

FIG. 1 is a vertical cross-sectional view illustrating an overall configuration of an image forming apparatus 1 according to illustrative embodiments. FIG. 2 is a vertical cross-sectional view illustrating an example of a configuration of a process cartridge 6 included in the image forming apparatus 1. A configuration and operations of the image forming apparatus 1 employing an electrophotographic method are described in detail below with reference to FIGS. 1 and 2.

The image forming apparatus 1 includes four process cartridges 6 each including a drum-type photoconductor 2 serving as an image carrier, a charger 3 including a charging roller, a developing device 4, and a cleaning device 5; a transfer device 7 disposed above the process cartridges 6; a toner cartridge 8 for storing toner of a specific color, that is, yellow, cyan, magenta, or black, disposed above the transfer device 7; and a scanner 9 disposed above the toner cartridge 8.

The image forming apparatus 1 further includes an optical writing device 10 disposed below the process cartridges 6, a waste toner tank 11 disposed below the optical writing device 10, a first sheet feed tray 12 of a sheet feeder provided next to the waste toner tank 11 to store and supply a recording medium such as a sheet of paper, plastic, or the like, and a second sheet feed tray 13 disposed below the waste toner tank 11 and the first sheet feed tray 12.

A secondary transfer roller 15 is disposed facing an intermediate transfer belt 14 of the transfer device 7. A sheet having a transferred image thereon passed between the intermediate transfer belt 14 and the secondary transfer roller 15 is then conveyed to a fixing device 16 disposed above the secondary transfer roller 15. The fixing device 16 includes a fixing roller 16*a* and a pressing roller 16*b* that together apply heat and pressure to the sheet.

When an image forming process is started, the photoconductor 2 is rotated in a clockwise direction in FIGS. 1 and 2 and the charger 3 evenly charges a surface of the photoconductor 2. Subsequently, the optical writing device 10 serving as a latent image forming means including, for example, LED arrays or a laser scanning device that scans laser light to optically write data, directs light L modulated by image data onto the surface of the photoconductor 2 to form an electrostatic latent image on the surface of the photoconductor 2.

The developing device 4 stores developer that includes toner used to develop the latent image. The toner is supplied to the electrostatic latent image formed on the surface of the photoconductor 2 by a developing roller 4*a* included in the developing device 4, so that a toner image is formed on the surface of the photoconductor 2. The photoconductor 2 having the toner image thereon is then further rotated to transfer the toner image onto the intermediate transfer belt 14. The toner images respectively formed by the process cartridges 6 are sequentially transferred onto the intermediate transfer belt 14 in a superimposed manner, so that, ultimately, a full-color toner image is formed on the intermediate transfer belt 14. The full-color toner image thus formed is then transferred onto the sheet conveyed between the intermediate transfer belt 14 and the secondary transfer roller 15.

The intermediate transfer belt 14 of the transfer device 7 is wound around conveyance rollers 7*a*, 7*b*, and 7*c*, and is rotated in a counterclockwise direction in FIG. 1. The intermediate transfer belt 14 transfers the full-color toner image onto the sheet as described above and conveys the sheet having the transferred full-color toner image thereon to the fixing device 16. In the fixing device 16, heat and pressure are applied to the sheet by the fixing roller 16*a* and the pressing roller 16*b* to fix the full-color toner image on the sheet. Thereafter, the sheet having the fixed image thereon is discharged from the image forming apparatus 1.

After the toner image is transferred onto the intermediate transfer belt 14, the photoconductor 2 is further rotated to reach the cleaning device 5. In the cleaning device 5, residual toner adhering to the surface of the photoconductor 2 is removed by a cleaning blade 5*a* or its equivalent. Thereafter, the photoconductor 2 is evenly charged again by the charger 3 to be ready for the next image forming sequence. It is to be noted that reference numeral 34 in FIG. 2 denotes a cleaner for the charger 3 including the charging roller.

Figure 3:
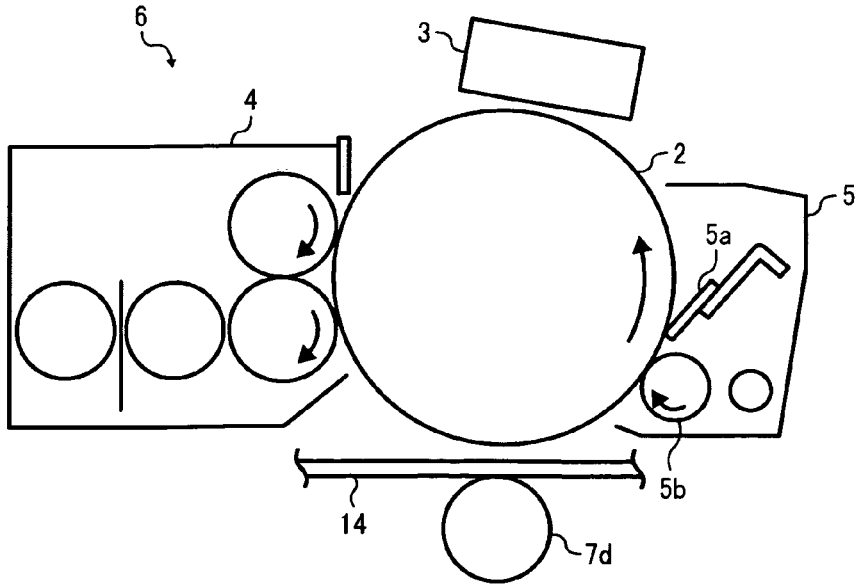
FIG. 3 is a vertical cross-sectional view illustrating the process cartridge during removal of discharge products.
Figure 4:
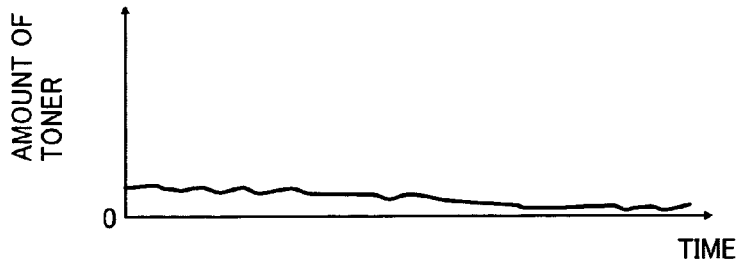
FIG. 4 is a graph showing an amount of toner attached to a photoconductor during removal of discharge products.

FIG. 3 is a vertical cross-sectional view illustrating the process cartridge 6 during removal of discharge products. FIG. 4 is a graph showing an amount of toner attached to the photoconductor 2 during removal of discharge products. It is to be noted that arrangement of the components in the process cartridge 6 illustrated in FIG. 3 is slightly different from that in the process cartridge 6 illustrated in FIG. 2. Specifically, the charger 3 is disposed above the photoconductor 2. Further, the intermediate transfer belt 14 is disposed below the process cartridge 6, and the direction of rotation of the photoconductor 2 in FIG. 3 is opposite to that shown in FIGS. 1 and 2, that is, the photoconductor 2 is rotated in a counterclockwise direction in FIG. 3. However, the same operations described above are performed by the process cartridge 6 illustrated in FIG. 3.

During removal of discharge products, the photoconductor 2, the developing device 4, and the cleaning device 5 are driven for an operating time calculated based on temperature, humidity, and a period of time for which driving of the photoconductor 2 is stopped (hereinafter referred to as a stop time) without applying a bias to the developing device 4 and the charger 3 while a transfer roller 7*d* serving as a primary transfer means of the transfer device 7 is separated from the photoconductor 2. Not only the photoconductor 2 but also the developing device 4 is driven without applying the bias to the developing device 4 as described above, so that a smaller amount of toner that rarely causes scum to appear on the surface of the photoconductor 2 is attached to the surface of the photoconductor 2 as illustrated in FIG. 4. Accordingly, discharge products adhering to the surface of the photoconductor 2 can be removed more fully. Further, because the toner is supplied to the surface of the photoconductor 2 by the developing device 4, the cleaning device 5 is simultaneously driven to collect the residual toner adhering to the surface of the photoconductor 2 and to convey the collected toner and se the like to the outside of the cleaning device 5.

If the bias is applied to the developing device 4, the amount of toner attached to the surface of the photoconductor 2 is increased. Although such an increase in the amount of toner improves removability of the discharge products and the like, an amount of toner collected by the cleaning device 5 is increased because the developing process is performed while the transfer roller 7*d* is separated from the photoconductor 2. Consequently, load on the cleaning device 5 also increases as does consumption of the toner, causing a cost increase. To solve such problems, the bias is not applied to the developing device 4 during removal of the discharge products.

If the bias is applied to the charger 3, the toner is not attached to the surface of the photoconductor 2 even when the developing device 4 is driven. Accordingly, the bias is not applied to the charger 3 during removal of the discharge products. In such a case, because the surface of the photoconductor 2 is not charged, a mechanism capable of contacting and separating from the photoconductor 2 is provided as the charger 3 when the charger 3 employs a contact-type system.

The same effects as those obtained by the above-described illustrative embodiments can be achieved in a case in which the cleaning device 5 includes a cleaning brush roller 5*b* or the like in addition to the cleaning blade 5*a* as illustrated in FIG. 3.

Figure 5:
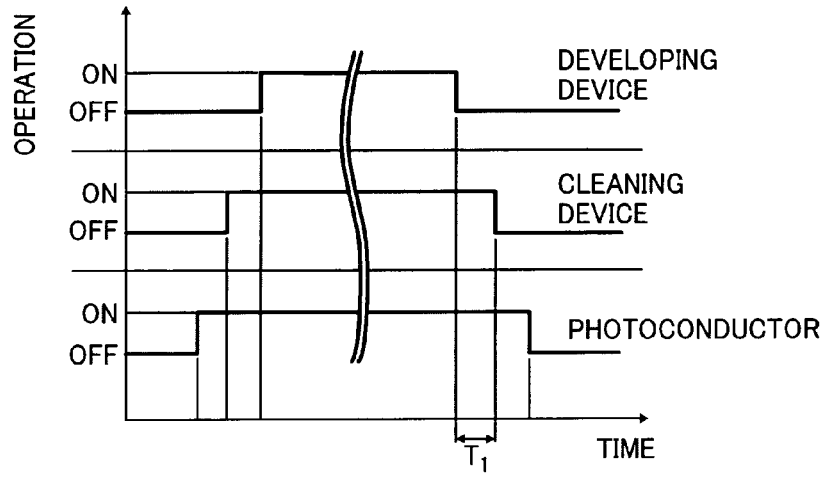
FIG. 5 is a timing chart showing operations of each of the photoconductor, a developing device, and a cleaning device.

FIG. 5 is a timing chart showing operations of each of the photoconductor 2, the developing device 4, and the cleaning device 5. At the start of removal of the discharge products, driving of the photoconductor 2, the cleaning device 5, and the developing device 4 is started, in that order. Upon completion of removal of the discharge products, driving of the developing device 4, the cleaning device 5, and the photoconductor 2 is stopped, in that order.

Upon completion of driving of the developing device 4 and the cleaning device 5, a difference $T_1$ between when the developing device 4 stops and when the cleaning device 5 stops is set to be greater than a time required for the entire surface of the photoconductor 2, which is rotated through the developing device 4 (of which driving is stopped), to rotate once through the cleaning device 5, to allow the cleaning device 5 to clean the whole surface of the photoconductor 2. Because the toner is supplied to the surface of the photoconductor 2 while the developing device 4 is driven, driving of the cleaning device 5 and the photoconductor 2 is stopped after all the toner adhering to the surface of the photoconductor 2 is removed by the cleaning device 5.

Figure 6:
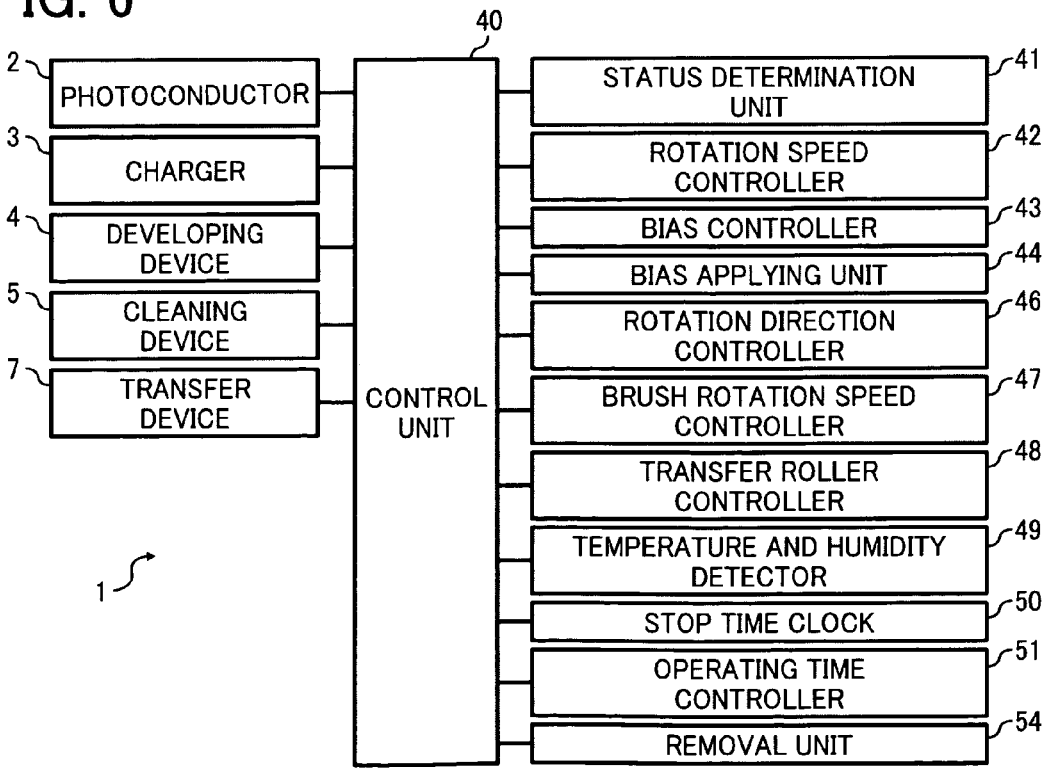
FIG. 6 is a block diagram illustrating a configuration of a control system of the image forming apparatus for performing removal of discharge products according to illustrative embodiments.

FIG. 6 is a block diagram illustrating a configuration of a control system of the image forming apparatus 1 that performs removal of discharge products described above.

As described above, the image forming apparatus 1 includes the photoconductor 2, the charger 3, the developing device 4, the transfer device 7, and the cleaning device 5. The image forming apparatus 1 further includes a control unit 40, which may be a microprocessor, a status determination unit 41 that determines a status of the photoconductor 2, a rotation speed controller 42 that controls a rotation speed of the photoconductor 2, a bias controller 43 that controls application of a bias to the charger 3, a bias applying unit 44 that applies a bias to the developing device 4 in pulses, a rotation direction controller 46 that controls a direction of rotation of the cleaning brush roller 5*b*, a brush rotation speed controller 47 that controls a rotation speed of the cleaning brush roller 5*b*, a transfer roller controller 48 that separates the transfer roller 7*d* from the photoconductor 2, a temperature and humidity detector 49 that detects temperature and humidity, a stop time clock 50 that measures the stop time of the photoconductor 2, and an operating time controller 51 that controls the operating time for removing the discharge products at startup of the photoconductor 2 under the control of the control unit 40.

The control unit 40 determines the operating time at startup of the photoconductor 2 and controls the operating time controller 51 to appropriately change the operating time based on the temperature and humidity detected by the temperature and humidity detector 49 and the stop time measured by the stop time clock 50.

More specifically, while the image forming apparatus 1 warms up, the photoconductor 2, the developing device 4, and the cleaning device 5 are driven without applying a bias to the charger 3 and the developing device 4 while the transfer roller 7*d* is separated from the photoconductor 2 as described above. Removal of the discharge products from the surface of the photoconductor 2 is performed via a removal unit 54 connected to the control unit 40 for a period of time necessary for the removal operation as calculated based on the temperature and humidity detected by the temperature and humidity detector 49 and the stop time measured by the stop time clock 50.

The present invention is applicable to image forming apparatuses regardless of the particular transfer method that they may employ, whether an intermediate transfer method or a direct transfer method. Further, the same effects as those obtained by the foregoing illustrative embodiments can be achieved regardless of the type of image forming apparatus, whether a monochrome image forming apparatus or a full-color image forming apparatus.

According to illustrative embodiments, removal of the discharge products from the surface of the photoconductor 2 is performed before images are output when problems caused by the discharge products are most likely to occur, that is, when the image forming apparatus 1 is turned off for a long period of time under high-temperature and high-humidity conditions.

As described above, removal of the discharge products from the surface of the photoconductor 2 is performed by driving the photoconductor 2, the developing device 4, and the cleaning device 5. As a result, provision of additional members for removing the discharge products from the surface of the photoconductor 2 is not necessary, preventing a cost increase.

In order to prevent generation of the discharge products during removal of the discharge products from the surface of the photoconductor 2, a bias is not applied to the charger 3 and the charging operation is not performed by the charger 3. Further, a bias is not applied to the developing device 4 so that toner consumption is reduced. The operating time for removing the discharge products from the surface of the photoconductor 2 is varied depending on the stop time and the condition, thereby minimizing the warm-up period.

Figure 7A:
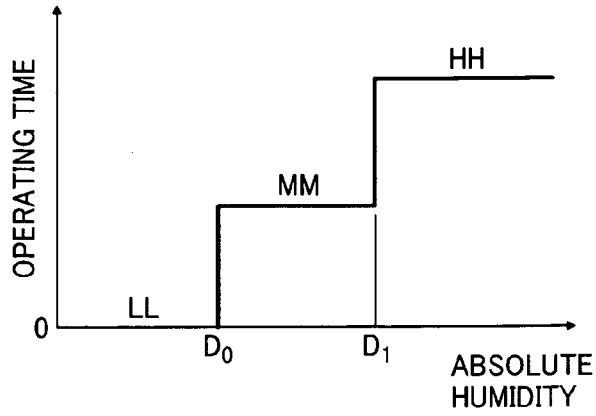
FIGS. 7A to 7C are graphs respectively showing a method for calculating an operating time for removing discharge products.
Figure 7B:
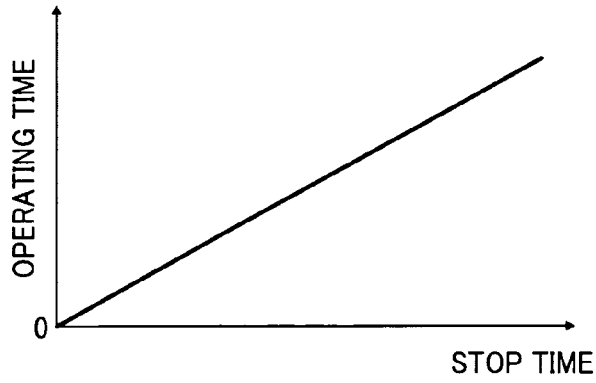
Figure 7C:
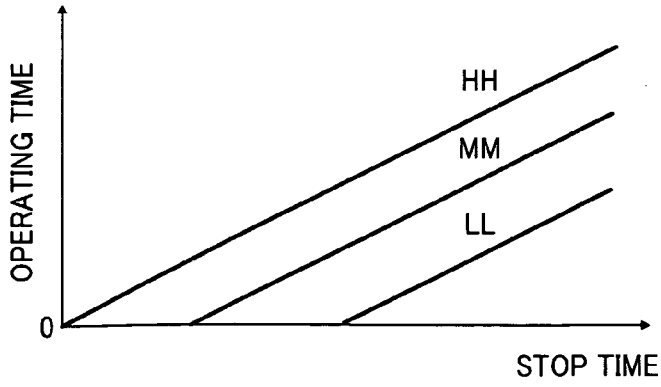

FIGS. 7A to 7C are graphs respectively showing several different methods for calculating the operating time for removing the discharge products from the surface of the photoconductor 2.

Specifically, FIG. 7A is a graph showing how to set a first operating time for removing the discharge products using the temperature and humidity detector 49. First, an absolute humidity D is calculated based on the temperature and the humidity detected by the temperature and humidity detector 49 to determine the condition based on the absolute humidity D thus calculated. Subsequently, the first operating time for removing the discharge products from the surface of the photoconductor 2 is calculated based on the absolute humidity D as illustrated in FIG. 7A.

It is to be noted that although two thresholds $D_0$ and $D_1$ are set for the absolute humidity D in FIG. 7A, the number of thresholds is not particularly limited. Alternatively, in place of the absolute humidity D, the first operating time may be determined based on the temperature and the humidity detected by the temperature and humidity detector 49. Further alternatively, instead of determining the first operating time by determining the temperature, the humidity, or the absolute humidity D based on the thresholds as described above, the first operating time for removing the discharge products from the surface of the photoconductor 2 may be preemptively set based solely on the absolute humidity D.

FIG. 7B is a graph showing how to set a second operating time for removing the discharge products using the stop time clock 50. Although the second operating time is set proportional to the stop time as illustrated in FIG. 7B, alternatively, a threshold for the stop time may be provided to perform removal of the discharge products for the operating time after drive of the photoconductor 2 is stopped for a predetermined period of time.

FIG. 7C is a graph showing how to set the operating time for removal of the discharge products from the surface of the photoconductor 2 using the control unit 40. The control unit 40 determines the operating time required for removal of the discharge products based on the results obtained by the temperature and humidity detector 49 and the stop time clock 50. In FIG. 7C, the operating time to drive the removal unit 54 for removing the discharge products from the surface of the photoconductor 2 is extended based on an amount of the discharge products adhering to the surface of the photoconductor 2 that exceeds an amount of the discharge products that causes irregular images.

Figure 8:
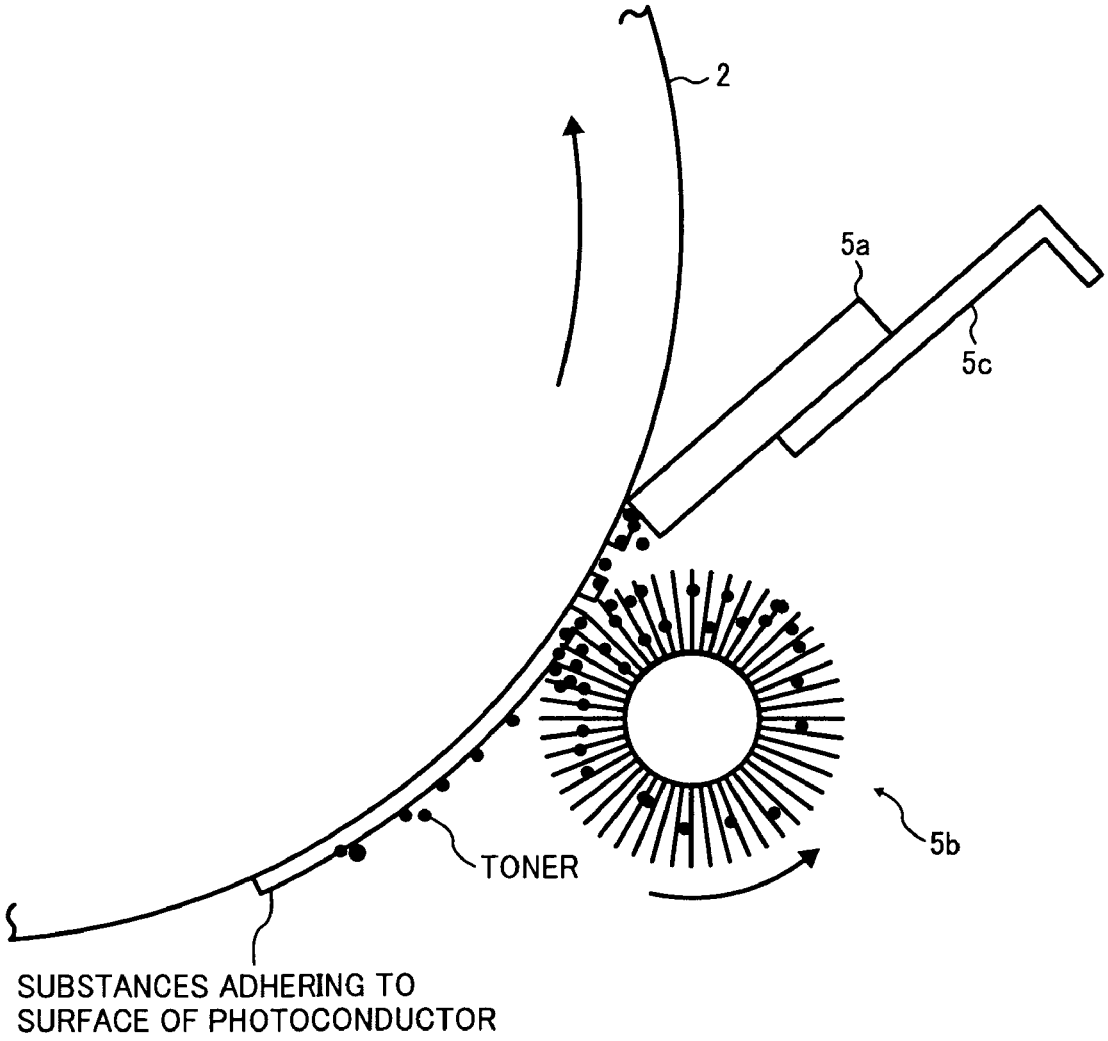
FIG. 8 is an enlarged schematic view illustrating a configuration of a cleaning device having a cleaning blade and a cleaning brush roller disposed therein.

FIG. 8 is an enlarged schematic view illustrating a configuration of the cleaning device 5 including the cleaning blade 5*a* and the cleaning brush roller 5*b*. The cleaning blade 5*a* includes an elastic body made, for example, of rubber. One edge of the cleaning blade 5*a* is fixed to a blade holder 5*c* with an adhesive agent or the like. The other edge of the cleaning blade 5*a* (hereinafter referred to as the leading edge of the cleaning blade 5*a*) is contacted against the surface of the photoconductor 2 to collect residual toner adhering to the surface of the photoconductor 2 after transfer of the toner image onto the intermediate transfer belt 14. Specifically, the cleaning blade 5*a* contacts the surface of the photoconductor 2 against the direction of rotation of the photoconductor 2 so that the surface of the photoconductor 2 can be more fully cleaned and the discharge products adhering to the surface of the photoconductor 2 are reliably removed by the cleaning blade 5*a*.

The cleaning brush roller 5*b* includes a metal core serving as a shaft and a sheet member having brush fibers wound around the metal core. The cleaning brush roller 5*b* is rotated while leading edges of the brush fibers contact the surface of the photoconductor 2, similarly to the cleaning blade 5*a*, to collect the residual toner adhering to the surface of the photoconductor 2 after transfer of the toner image onto the intermediate transfer belt 14.

The cleaning brush roller 5*b* is provided upstream from the cleaning blade 5*a* in the direction of rotation of the photoconductor 2, so that the residual toner adhering to the surface of the photoconductor 2 is removed by the cleaning brush roller 5*b* as well as the cleaning blade 5*a*, thereby reliably removing the residual toner and the discharge products adhering to the surface of the photoconductor 2.

Because the cleaning brush roller 5*b* is rotated while contacting the surface of the photoconductor 2, the surface of the photoconductor 2 is gradually abraded. In order to extend the product life of the photoconductor 2, rotation speed of the cleaning brush roller 5*b* is set such that the surface of the photoconductor 2 is not abraded while providing higher cleaning performance, specifically by minimizing any difference in rotation speed between the cleaning brush roller 5*b* and photoconductor 2. However, because the toner and the discharge products adhering to the surface of the photoconductor 2 must be removed quickly, the rotation speed of the cleaning brush roller 5*b* is changed to increase the difference in rotation speed between the cleaning brush roller 5*b* and the photoconductor 2 in order to provide superior cleaning and removal performance.

More specifically, the rotation speed controller 42 and the brush rotation speed controller 47 respectively set the rotation speeds of the photoconductor 2 and the cleaning brush roller 5*b* during removal of the discharge products to rotation speeds that are different from those during printing operations. The difference in rotation speed between the cleaning brush roller 5*b* and the photoconductor 2 is increased to enhance cleaning performance of the cleaning brush roller 5*b*, thereby reliably removing the residual toner and the discharge products from the surface of the photoconductor 2.

In addition to differences in rotation speeds, the degree of abrasion of the surface of the photoconductor 2 also differs depending on a direction of rotation of the cleaning brush roller 5*b*.

Figure 9A:
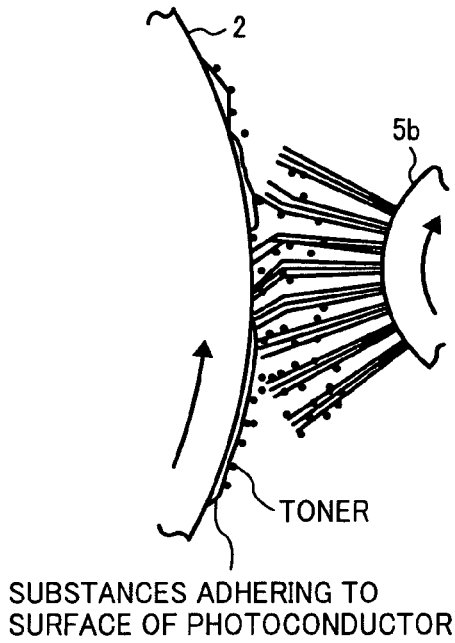
FIG. 9A is an enlarged schematic view illustrating a state in which the cleaning brush roller is rotated in a forward direction.
Figure 9B:
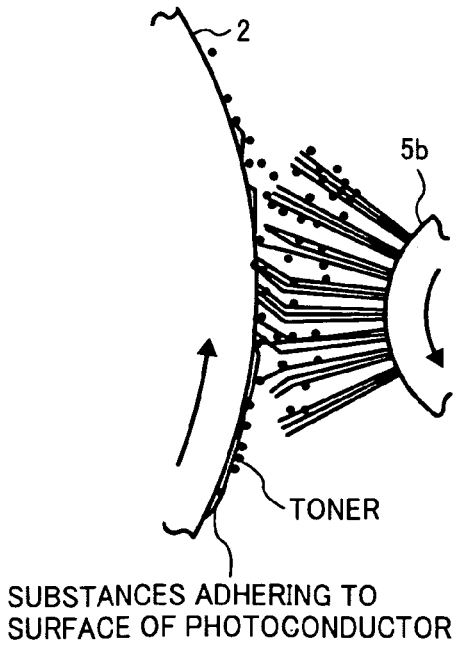
FIG. 9B is an enlarged schematic view illustrating a state in which the cleaning brush roller is rotated in a reverse direction.

FIG. 9A is an enlarged schematic view illustrating a state in which the cleaning brush roller 5*b* is rotated in the opposite direction to the direction of rotation of the photoconductor 2 (hereinafter referred to as a forward direction). In this case, the forward direction is clockwise. FIG. 9B is an enlarged schematic view illustrating a state in which the cleaning brush roller 5*b* is rotated in the same direction as the direction of rotation of the photoconductor 2 (hereinafter referred to as a reverse direction). In this case, the reverse direction is counter-clockwise.

In order to prevent abrasion of the surface of the photoconductor 2, the cleaning brush roller 5*b* is rotated in the forward direction as illustrated in FIG. 9A during normal printing operations. By contrast, during removal of the discharge products, the direction of rotation of the cleaning brush roller 5*b* is reversed so that the cleaning brush roller 5*b* is rotated in the reverse direction as illustrated in FIG. 9B, that is, in this case, counter-clockwise. Accordingly, the difference in relative rotation speeds between the cleaning brush roller 5*b* and the photoconductor 2 is increased to reliably remove the residual toner and the discharge products from the surface of the photoconductor 2. In conjunction with the temperature and humidity detector 49 and the stop time clock 50, the control unit 40 minimizes the time needed for removal of the discharge products from the surface of the photoconductor 2 by changing both the relative rotation speeds of the photoconductor 2 and the cleaning brush roller 5*b* and the direction of rotation of the cleaning brush roller 5*b*.

As described above, the way the cleaning brush roller 5*b* operates is changed based on the direction of rotation of the cleaning brush roller 5*b*. Specifically, the discharge products adhering to the surface of the photoconductor 2 are more reliably removed by the cleaning brush roller 5*b* when the cleaning brush roller 5*b* is rotated in the reverse direction. However, if the cleaning brush roller 5*b* is continuously rotated in the reverse direction in order to improve cleaning performance, the surface of the photoconductor 2 is abraded, shortening the product life of the photoconductor 2. To prevent such a problem, the rotation direction controller 46 is provided to switch the direction of rotation of the cleaning brush roller 5*b* under the control of the control unit 40, so that the cleaning brush roller 5*b* is rotated in the reverse direction only during removal of the discharge products from the surface of the photoconductor 2.

In addition, in order to minimize removal time, the way the toner is supplied is changed depending on what the detection results supplied by the temperature and humidity detector 49 and the stop time clock 50 show regarding the amount of the discharge products adhering to the surface of the photoconductor.

Figure 10:
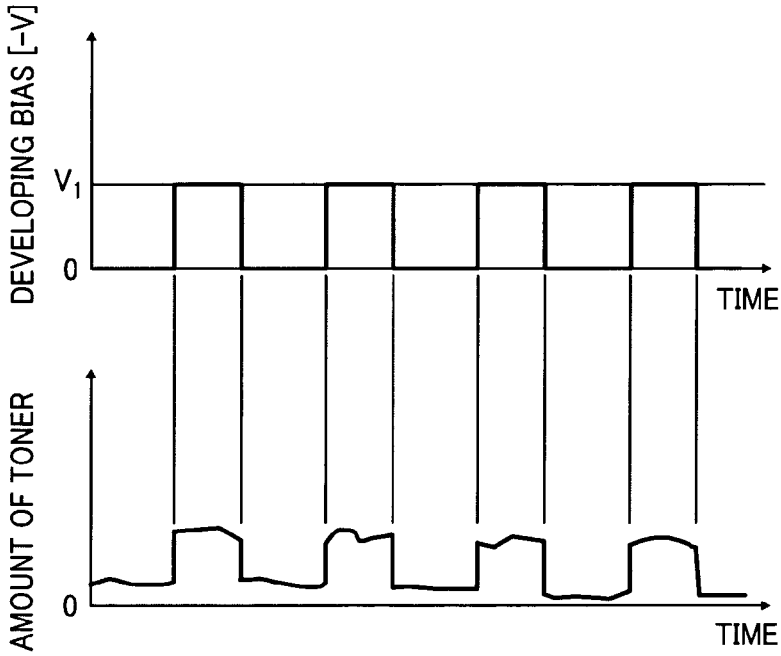
FIG. 10 is a graph showing an amount of toner supply when a developing bias is applied in pulses.

For example, FIG. 10 is a graph showing an amount of toner supply when the developing bias is applied in pulses. Returning to FIGS. 6 and 7, the bias is applied to the developing device 4 in pulses by the bias applying unit 44 during removal of the discharge products.

When the temperature and humidity detector 49 and the stop time clock 50 determine that a large amount of the discharge products adheres to the surface of the photoconductor 2, the developing bias is applied to the developing device 4 in pulses to intermittently supply the toner to the surface of the photoconductor 2, thereby preventing too much extension of the operating time for removing the discharge products. As a result, removal performance of the cleaning blade 5*a* and the cleaning brush roller 5*b* is increased. The reason for this pulsed application of toner is as follows.

If the photoconductor 2, the developing device 4, and the cleaning device 5 are driven without applying the developing bias to the developing device 4, only a slight amount of the toner is supplied to the surface of the photoconductor 2. Consequently, the operating time for removing the discharge products is extended when a large amount of the discharge products adheres to the surface of the photoconductor 2. In order to shorten the operating time for removing the discharge products, an amount of the toner supplied to the surface of the photoconductor 2 is increased.

However, if the toner is continuously supplied to the surface of the photoconductor 2, the cleaning device 5 is required to continuously remove and collect residual toner adhering to the surface of the photoconductor 2 without performing transfer of the toner image onto the intermediate transfer belt 14. Consequently, a load on the cleaning device 5 is increased, causing chipping and the like of the cleaning blade 5*a* or the like.

To prevent the above-described problem, the developing bias is applied to the developing device 4 in pulses such that an amount of toner supplied to the surface of the photoconductor 2 is increased for each pulse in order to intermittently supply the toner to the surface of the photoconductor 2. Accordingly, the discharge products adhering to the surface of the photoconductor 2 are more reliably removed while a load on the cleaning device 5 is reduced, and the operating time for removing the discharge products is minimized. It is to be noted that the control unit 40 determines whether or not it is necessary to apply the developing bias to the developing device 4 in pulses depending on the operating time presumed to be required for removing the discharge products as calculated by the temperature and humidity detector 49 and the stop time clock 50.

The present disclosure is particularly significant in view of the advantages in imaging quality and the like provided by the corona charger over a roller charger, as is now described.

Figure 11:
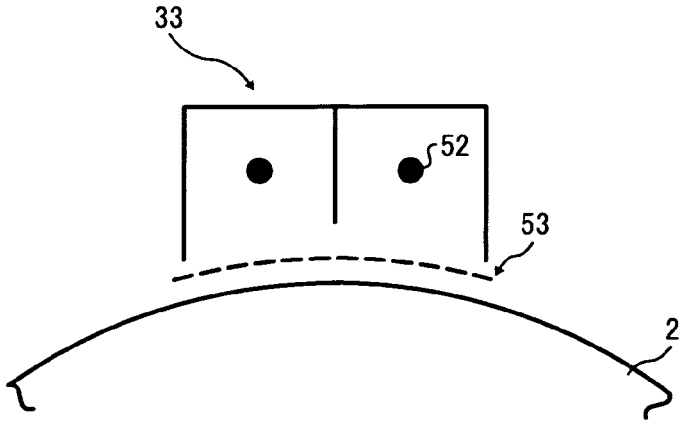
FIG. 11 is a schematic view illustrating an example of a configuration of a charger employing a corona discharge system.

FIG. 11 is a schematic view illustrating an example of a configuration of a corona charger 33 employing a corona discharge system. The corona charger 33 illustrated in FIG. 11 includes a discharge member 52 and a potential control member 53 serving as an absorbent of the discharge products provided near the discharge member 52.

A corona charging method and a roller charging method are widely known as a method employed in chargers. The roller charging method is more effective than the corona charging method for reducing generation of the discharge products. However, irregular charging due to contamination of a roller or an inability to handle higher printing speed may occur in the roller charging method. Therefore, it is preferable to employ the corona charging method in order to extend the product life of the charger in higher-speed image forming apparatuses. Although generation of the discharge products is increased in the corona charging method, generation of irregular images including image deterioration, white spots, and the like may be prevented by performing removal of the discharge products according to illustrative embodiments, thereby reliably handling higher printing speed and extending the product life.

Further, the potential control member 53 serving as an absorbent of the discharge products is provided to absorb the discharge products remaining in an installation space for the corona charger 33. Accordingly, an amount of the discharge products dropping onto the surface of the photoconductor 2 when the image forming apparatus 1 is turned off is reduced, shortening the operating time for removing the discharge products from the surface of the photoconductor 2. Alternatively, in a case in which a scorotron charging method is employed, a wire or an electrode is used as a discharge member and a grid or the like serving as a potential control member is provided between the charger 33 and the photoconductor 2 to provide the effects obtained by the above-described illustrative embodiments. The absorbent of the discharge products, that is, the potential control member 53, is provided to the charger 33 to absorb the discharge products before the discharge products drop onto the surface of the photoconductor 2 as described above, thereby preventing problems caused by the discharge products.

As described above, the amount of discharge products generated is also affected by the environment, which can be taken into account in setting the size of the charging bias that is applied to the charger.

Figure 12:
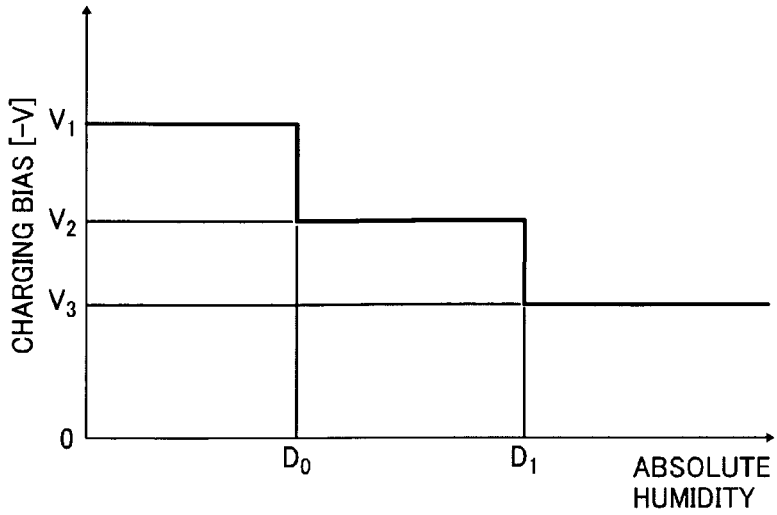
FIG. 12 is a graph showing changes in the size of a charging bias under different temperature and humidity conditions.

FIG. 12 is a graph showing changes in the size of the charging bias applied to the charger 3 or 33 under different temperature and humidity conditions. Under high-temperature and high-humidity conditions, in which the amount of discharge products adhering to the surface of the photoconductor 2 is increased, the size of the bias applied to the charger 3 or 33 is reduced to reduce an amount of discharge products generated by electric discharge of the charger 3 or 33.

The discharge products have higher water absorbency, and tend to adhere to the surface of the photoconductor 2 under the high-temperature and high-humidity conditions, causing irregular images including image deterioration, white spots, and the like. Therefore, the size of the bias applied to the charger 3 or 33 is changed depending on the temperature and the humidity detected by the temperature and humidity detector 49. p Although the size of the charging bias applied to the charger 3 or 33 is changed depending on the absolute humidity D calculated by the temperature and humidity detector 49 in FIG. 12, alternatively, the size of the charging bias may be changed depending on the temperature or relative humidity. In addition, it is to be noted that although two thresholds $D_o$ and $D_1$ are set for the absolute humidity D in FIG. 12, the number of thresholds is not particularly limited. Further, the size of the charging bias applied to the charger 3 or 33 may be changed depending on the absolute humidity D.

The charging bias applied to the charger 3 or 33 is reduced under high-temperature and high-humidity conditions so that an amount of the discharge products generated by electric discharge of the charger 3 or 33 is reduced, thereby shortening the operating time for removing the discharge products from the surface of the photoconductor 2.

As illustrated in FIG. 6, the status determination unit 41 that determines the status of the photoconductor 2 is provided so that the control unit 40 changes the operating time for removing the discharge products from the surface of the photoconductor 2 depending on the status of the photoconductor 2.

However, the status of the surface of the photoconductor 2 is not constant but changes depending on the number of sheets printed, and changes in the status of the surface of the photoconductor 2 affect attachability of the discharge products to the surface of the photoconductor 2. The status determination unit 41 counts the number of printed sheets so that the operating time for removing the discharge products adhering to the surface of the photoconductor 2 can be changed based on the status of the surface of the photoconductor 2, thereby minimizing the operating time.

In other words, because attachability of the discharge products to the surface of the photoconductor 2 varies depending on the status of the surface of the photoconductor 2 as described above, the operating time required for removing the discharge products from the surface of the photoconductor 2 also varies. Therefore, the status determination unit 41 is provided to shorten the operating time required for removing the discharge products from the surface of the photoconductor 2, thereby extending the product life of the photoconductor 2.

In addition to a means for counting the number of printed sheets provided as the status determination unit 41, alternatively a means for measuring the number of rotations of the photoconductor 2 or a cumulative distance traveled by the photoconductor 2 may be used as the status determination unit 41. In any case, the control unit 40 changes the operating time for removing the discharge products from the surface of the photoconductor 2 as appropriate depending on the number of printed sheets, the number of rotations of the photoconductor 2, or the cumulative distance traveled by the photoconductor 2 measured by the status determination unit 41.

Figure 13:
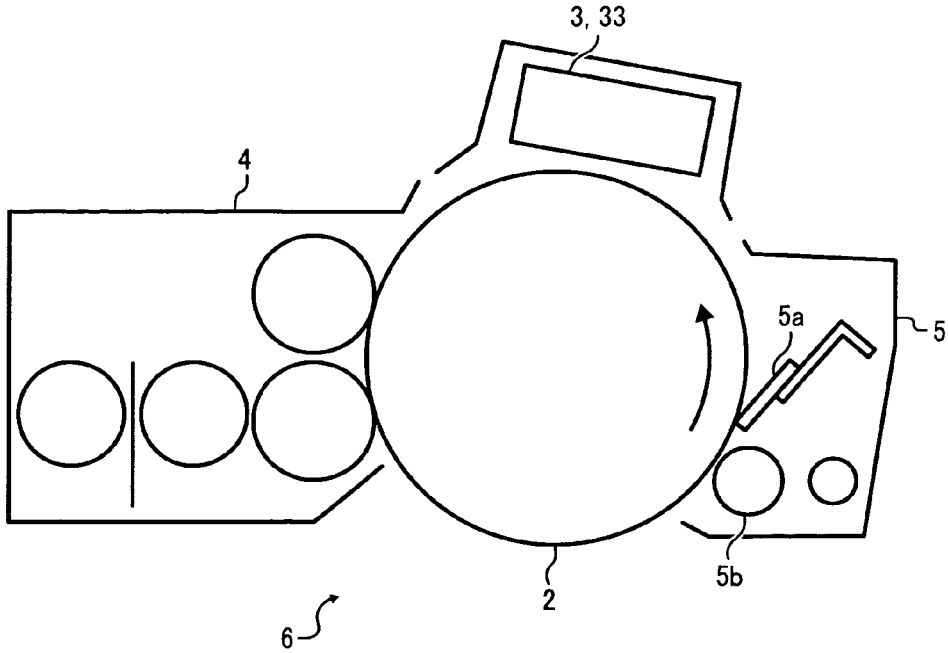
FIG. 13 is a vertical cross-sectional view illustrating another example of a configuration of a process cartridge removably installable in the image forming apparatus illustrated in FIG. 1.

FIG. 13 is a vertical cross-sectional view illustrating another example of a configuration of the process cartridge 6. Specifically, the process cartridge 6 illustrated in FIG. 13 is removably installable in the image forming apparatus 1 according to illustrative embodiments. The photoconductor 2, the charger 3 or 33, the developing device 4, the cleaning device 5 including the cleaning blade 5*a* and the cleaning brush roller 5*b* are formed as a single integrated unit as the process cartridge 6 removably installable in the image forming apparatus 1 for ease of maintenance when, for example, the above-described component is replaced with a new component.

Specifically, the process cartridge 6 includes the drum-type photoconductor 2 serving as an image carrier, the charger 3 or 33 that charges the surface of the photoconductor 2, the developing device 4 that develops an electrostatic latent image formed on the surface of the photoconductor 2 with toner to form a toner image on the surface of the photoconductor 2, a lubricant applicator, not shown, and the cleaning device 5 that removes residual toner adhering to the surface of the photoconductor 2 after transfer of the toner image.

Image forming apparatuses employing an electrophotographic method generally have a complex configuration, and consequently, it is difficult to replace individual components of the image forming apparatuses. However, with the process cartridge 6 illustrated in FIG. 13, in which the components are formed as a single integrated unit, this component can be easily replaced with a new component for superior ease of maintenance.

As described above, in the image forming apparatus 1 according to the foregoing illustrative embodiments, the control unit 40 determines and changes, the operating time for removing the discharge products from the surface of the photoconductor 2 at startup of the photoconductor 2 based on the temperature and the humidity detected by the temperature and humidity detector 49 and the stop time of the photoconductor 2 measured by the stop time clock 50. During the warm-up period, the photoconductor 2, the developing device 4, and the cleaning device 5 are driven without applying the bias to the charger 3 or 33 and the developing device 4 while the transfer roller 7*d* is separated from the photoconductor 2. Further, removal of the discharge products from the surface of the photoconductor 2 is performed by the removal unit 54 connected to the control unit 40 only for a period of time necessary for the removal operation calculated based on the temperature and the humidity detected by the temperature and humidity detector 49 and the stop time measured by the stop time clock 50.

It is to be noted that illustrative embodiments of the present invention are not limited to those described above, and various modifications and improvements are possible without departing from the scope of the present invention. It is therefore to be understood that, within the scope of the associated claims, illustrative embodiments may be practiced otherwise than as specifically described herein. For example, elements and/or features of different illustrative embodiments may be combined with each other and/or substituted for each other within the scope of the illustrative embodiments.

What is claimed is:

1. An image forming apparatus comprising:

an image carrier;

a charger to charge a surface of the image carrier;

an irradiating device to form a latent image on the surface of the image carrier;

a developing device to develop the latent image with toner to form a toner image on the surface of the image carrier;

a transfer device to transfer the toner image onto a recording medium;

a cleaning device to remove residual toner from the surface of the image carrier after transfer of the toner image;

a temperature and humidity detector to measure temperature and humidity within the image forming apparatus;

a stop time clock to measure a period of time for which the image carrier is not driven;

a removal unit to remove discharge products adhering to the surface of the image carrier when the image carrier, the developing device, and the cleaning device are driven without applying a bias to the charger while the transfer device is separated from the image carrier; and a control unit to drive the removal unit to remove the discharge products adhering to the surface of the image carrier for a period of time determined by the control unit based on measurements obtained by the temperature and humidity detector and the stop time clock.

2. The image forming apparatus according to claim 1, wherein the cleaning device comprises a cleaning blade and a cleaning brush roller.

3. The image forming apparatus according to claim 2, further comprising a rotation speed controller to set a rotation speed of the image carrier and the cleaning brush roller during removal of the discharge products different from rotation speed of the image carrier and the cleaning brush roller during printing operations.

4. The image forming apparatus according to claim 2, further comprising a rotation direction controller to switch a direction of rotation of the cleaning brush roller.

5. The image forming apparatus according to claim 1, wherein a bias is applied to the developing device in pulses during removal of the discharge products.

6. The image forming apparatus according to claim 1, wherein the charger comprises a corona charger including a discharge member and an absorbent to absorb the discharge products, the absorbent provided near the discharge member.

7. The image forming apparatus according to claim 1, wherein the bias applied to the charger is variable.

8. The image forming apparatus according to claim 1, further comprising a status determination unit to determine a status of the image carrier, the control unit changing an operation time for removal of the discharge products based on the status of the image carrier as determined by the status determination unit.

9. The image forming apparatus according to claim 1, wherein the image carrier, the charger, the developing device, and the cleaning device are formed as a single integrated unit, the single integrated unit removably installable in the image forming apparatus.

10. A process cartridge removably installable in an image forming apparatus, the process cartridge comprising:

an image carrier;

a charger to charge a surface of the image carrier;

a developing device to develop a latent image formed on the surface of the image carrier with toner to form a toner image on the surface of the image carrier; and a cleaning device to remove residual toner from the surface of the image carrier after transfer of the toner image, wherein, in a state in which the process cartridge is installed in the image forming apparatus, the image carrier, the developing device, and the cleaning device are driven without applying a bias to the charger while a transfer device included in the image forming apparatus is separated from the image carrier to remove discharge products adhering to the surface of the image carrier.

11. The process cartridge according to claim 10, wherein the image carrier, the developing device, and the cleaning device are driven for a period of time based on temperature and humidity within the image forming apparatus and a period of time for which the image carrier is not driven to remove the discharge products adhering to the surface of the image carrier.

12. An image forming apparatus comprising:

image bearing means for bearing a latent image;

charging means for charging a surface of the image bearing means;

irradiating means for irradiating the surface of the image bearing means to form a latent image on the surface of the image bearing means;

developing means for developing the latent image with toner to form a toner image on the surface of the image bearing means;

transfer means for transferring the toner image onto a recording medium;

cleaning means for removing residual toner from the surface of the image bearing means after transfer of the toner image;

temperature and humidity detection means for detecting temperature and humidity within the image forming apparatus;

stop time measurement means for measuring a period of time for which the image bearing means is not driven;

removing means for removing discharge products adhering to the surface of the image bearing means when the image bearing means, the developing means, and the cleaning means are driven without applying a bias to the charging means while the transfer means is separated from the image bearing means; and control means for driving the removing means to remove the discharge products adhering to the surface of the image bearing means for a period of time determined by the control means based on measurements obtained by the temperature and humidity detection means and the stop time measurement means.

* * * * *